United States Patent [19]

Darrell

[11] 4,370,696

[45] Jan. 25, 1983

[54] ELECTRIFIED GLOVE

[76] Inventor: Miklos Darrell, 7311 Denny Ave., Sun Valley, Calif. 91352

[21] Appl. No.: 266,886

[22] Filed: May 26, 1981

[51] Int. Cl.[3] ..... F41B 15/04

[52] U.S. Cl. ..... 361/232; 119/145; 128/419 S; 231/2 E; 272/27 N; 273/84 ES

[58] Field of Search ..... 361/232; 128/783, 419 S, 128/422; 272/27 N; 273/84 ES; 119/145; 231/2 E

[56] References Cited

U.S. PATENT DOCUMENTS 1,915,721 6/1933 Diaz ..... 361/232
3,819,108 6/1974 Jordan ..... 273/84 ES X
3,917,268 12/1975 Tingey et al. ..... 361/232 X
4,242,715 12/1980 Laird ..... 361/232

*Primary Examiner*—Reinhard J. Eisenzopf
*Attorney, Agent, or Firm*—Willie Krawitz

[57] ABSTRACT

An electrified glove is disclosed for subduing criminal suspects and arrested individuals. The glove includes a circuit powered by a small battery that may be rechargable and will deliver a continuous A.C. shock and intermittent D.C. shocks to open output terminals located on the glove exterior. The shocks will temporarily incapacitate a suspect or arrestee and enable him to be subdued and handcuffed, if necessary. The circuit design enables a number of shocks to be delivered before a recharge is required.

7 Claims, 4 Drawing Figures

ELECTRIFIED GLOVE

BACKGROUND OF THE INVENTION

This invention relates to a new device for temporarily incapacitating criminal suspects. The device is a glove that emits an electric shock and may be worn by a law enforcement officer for use in hand-to-hand combat, when subduing a suspect already in custody, or simply to threaten or intimidate an individual, etc. The device also may be employed when controlling mental patients, as a defense against animals, etc.

Various methods have been employed to subdue criminal suspects or dissuade them from criminal or potentially criminal acts. Simply shooting a suspect has involved police departments with a multitude of civil litigation and adverse publicity, and hence other methods of neutralizing or subduing a suspect are considered desirable. These methods include physical violence such as choke holds, and an assortment of wrestling grips. However, choke holds have resulted in the death of some suspects, and an ensuing spate of civil litigation.

The use of tranquilizer darts has also been employed, but this requires that the suspect be taken to a hospital to have the dart removed. This procedure involves the expense of a physician's fee and the arresting officer's time. There is also the potential litigation if the wrong person is injured, e.g., if the wounded individual was simply an innocent bystander, or suspect.

There is required a device that will be effective in subduing a criminal suspect prior to, or subsequent to arrest. Also, a device is desired which does not involve a dangerous grip being placed on the suspect and, does not employ use of a projectile.

The device should be effective in hand-to-hand combat, particularly if an officer has not had an opportunity to draw a weapon, or it would be inappropriate to do so, such as in a crowded area, or in a residence involving a domestic disturbance complaint. A device is also desired that may assist in controlling an unruly group or crowd of individuals without being unduly provocative by exposing clubs, guns, etc.

THE INVENTION

According to the invention, there is provided an electrified device that is preferably incorporated into a glove and worn by the user; the device is powered usually by one or more small D.C. batteries. The device employs electrical outlets that produce a continuous A.C. shock and intermittent D.C. shocks of sufficient magnitude to temporarily incapacitate an individual and enable an arresting officer to subdue a suspect in hand-to-hand combat. The device also may be used to subdue a suspect already in custody and enable him to be handcuffed or to prevent a handcuffed prisoner from continuing to resist arrest.

Basically, the A.C. shock has sufficient magnitude to initiate a temporary muscle spasm, and the D.C. shock is set to discharge before it becomes lethal. About a three second interval occurs between the D.C. discharge, which enables an arresting officer discretion to maintain or cease application of the discharge shock. The three second interval also enables the battery to set up for an additional discharge. The combined effect of the A.C. and D.C. shocks causes the recipient pain and temporary incapacitation, after which the suspect can be handcuffed, subdued, etc. Usually, the threat of additional shocks will deter an individual from further resisting arrest.

The circuit design of this invention provides an A.C. discharge of about 450–50,000 volts at about 100 milliamps, and a D.C. discharge of about 450–50,000 volts at about 100 milliamps using say, one to three 3 volt D.C. batteries, depending on the desired charge life and discharge intensity.

The device operates quite differently from, say, a cattle prod which uses a high voltage charge that will frequently stun or seriously injure an individual. The cattle prod type of device is also cumbersome and requires much larger batteries compared to those used in conjunction with the circuit of this invention.

DESCRIPTION OF THE PREFERRED EMBODIMENTS

Figure 1:
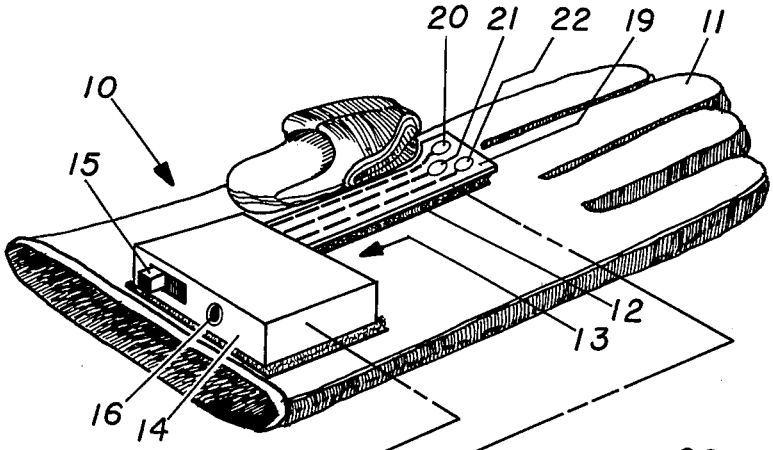
FIG. 1 is a perspective view showing the assembled glove of this invention.
Figure 2:
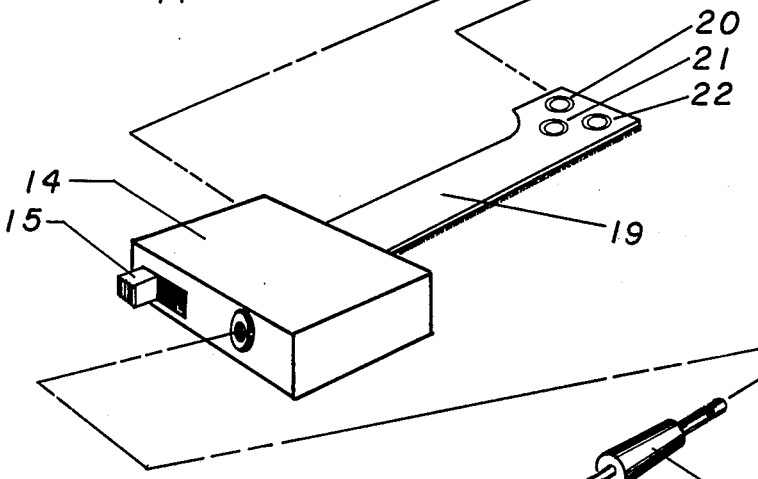
FIG. 2 is a perspective view showing the electrodes and circuitry which attach to the glove.
Figure 3:
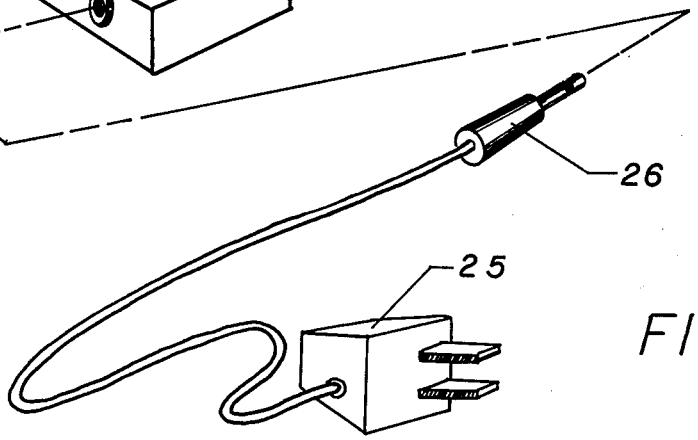
FIG. 3 shows the charging jack arrangement for the circuitry attachment; and, FIG. 4 is a circuit diagram employed to provide a continuous A.C. and intermittent D.C. pulses to the electrode of the glove.

The electrified device 10 of this invention is shown in FIG. 1 and includes a glove portion 11 of a suitable material such as neoprene; this material is a good electrical insulator. An area 12 of the glove is covered with "VELCRO" to provide an area of adhesion to which the circuit package can be affixed or removed. The circuit package 13 includes a container portion 14 for housing the circuitry, on-off switch 15, and charger outlet 16. The container is fairly small and typical dimensions are $2\frac{1}{2}'' \times 2'' \times 1''$. A connector strip 19, shown in FIGS. 1 and 2, is attached to the circuit package 13, and is also affixed to the pad by the "VELCRO" material. The connector strip 19 contains lead wires (dotted designation) connecting the circuitry to open discharge eyelets 20, 21 and 22. The connector strip functions to both insulate the wires and to protect them from physical damage.

A charging adaptor 25 connected to a charging jack 26 is provided to plug into the charging outlet 16 of the circuit package 13. The charging jack 26 may be adapted to disconnect the battery connection to the on-off switch during charging.

Figure 4:
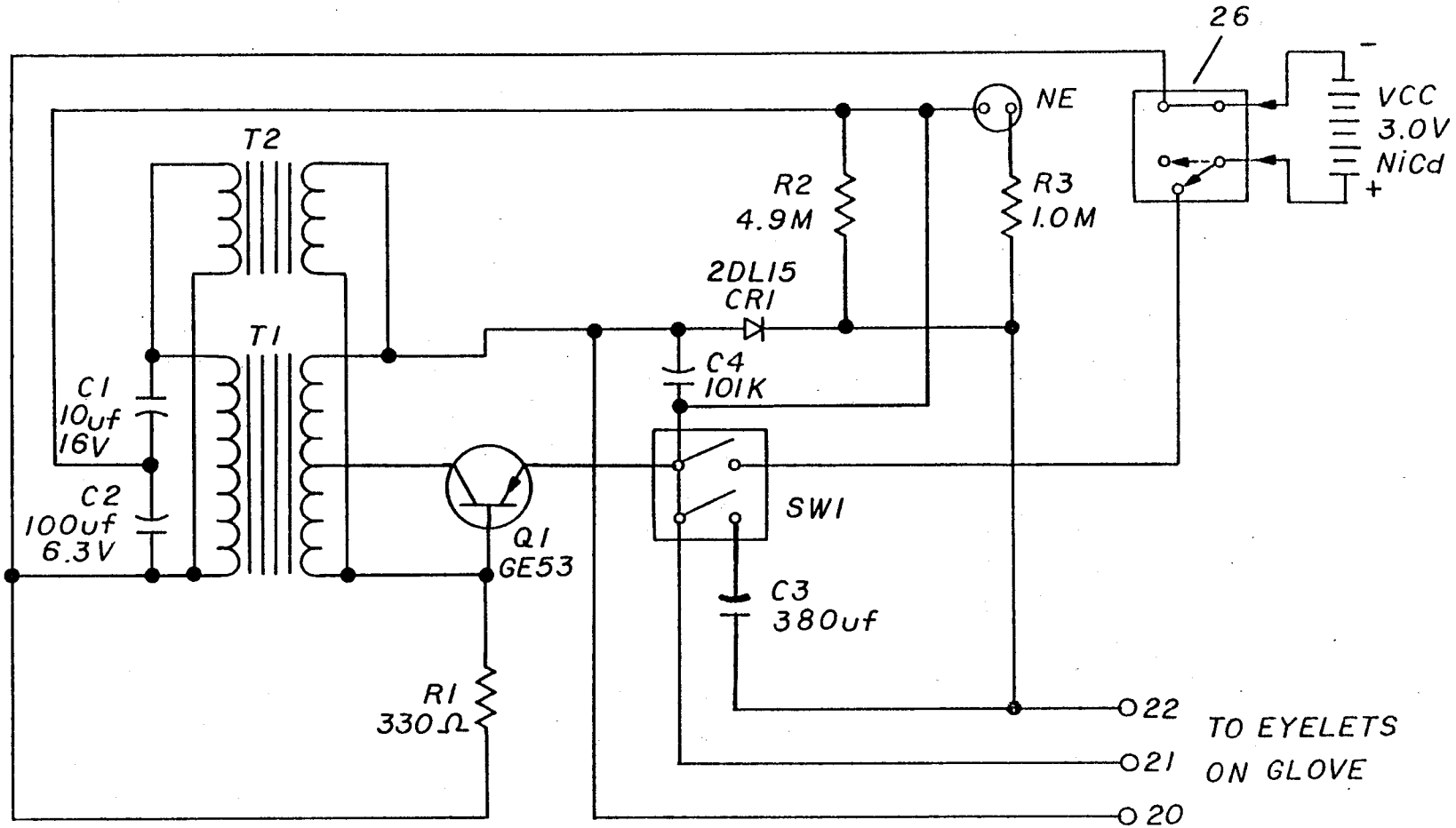

The circuit for supplying a charging shock to the eyelets 20, 21 and 22 is shown in FIG. 4. D.C. input power to the circuit is supplied from the negative of a 3 volt NiCd battery to one side of an iron core transformer T1. Power from the positive side of the battery is fed through an on-off, single throw, double pole slide switch SW1 and a D.C. to A.C. converter transistor Q1 to the center tap of the transformer T1. An iron core is used in the transformer to increase the voltage. A second iron core transformer T2 is in parallel with transformer T1 to increase amperage.

A resistor R1 between the transistor Q1 and the transformer stabilizes the transistor and sets it at the proper operating level. Capacitors C1 and C2 function as ripple filters. The A.C. output from the primary side of the transformer is fed to the base of transistor Q1 where it is converted to a higher A.C. voltage output, and then fed to a discharge eyelet 20. A.C. voltage from the transformer and Q1 is converted by a quarter wave diode rectifier CR1 to a rippled D.C. output and then fed to a discharge eyelet 22. A wire is connected between the emitter side of Q1 and a discharge eyelet 21. A neon light NE is used to indicate the device has been activated. The neon light is protected by a D.C. filter C4 and resistances R2 and R3. A charging capacitor C3 is employed to provide the pulsed D.C. charge to eyelet 22, and the resistors R2 and R3 also provide the necessary saturation for the timed discharge of C3. Reflected impedance signals from the terminals are buffered from the transistor Q1 by the capacitor C3, and this enables Q1 to operate continuously without becoming disabled.

When the switch is 'off' (as shown), the connections between the battery and Q1 are broken. Hence, neither an A.C. or D.C. charge will flow to the eyelets 20, 21 or 22. With the switch 'on' and the circuit values as indicated, there will be produced a continuous A.C. discharge of about 500–750 volts at 100 milliamps, and an intermittent D.C. discharge of 400–750 volts at 100 milliamps for about a two second period at about three second intervals. The specific discharge voltages are, of course, dependant on the extent of the battery charge.

The combined effect of the A.C and D.C. discharges is sufficient to incapacitate a suspect, assailant or prisoner with non-lethal force. The device eliminates the need for dangerous neck or choke holds, and increases the confidence of an officer when on duty. Also, it gives both a psychological and physical advantage to the officer when dealing with a physically superior suspect, or during an investigation when the situation does not call for a drawn gun.

The electrified glove of this invention enables a police officer to threaten a suspect, prisoner, or individual who refuses to comply with his command. Furthermore, in domestic disturbance situations which often can be dangerous, the device can be worn without being provocative. If the disturbance escalates, the device can be turned on and used to threaten or subude an individual. Moreover, in general, its use is available immediately and it does not require a long or complicated procedure to don the glove. Obviously, the present invention does not pose problems such as from stray or ricocheting bullets, and no medical treatment is needed after use. Finally, as indicated, the device is compact and may be easily stored and charged.

Various circuit equivalents of the present invention may be employed to effect the desired results. For example, transistors may be employed in place of the transformers to increase the voltage. In other parts of the circuit, transistors may be used to rectify the A.C. to an intermittent D.C. output and/or to increase amperage. Insofar as the glove is concerned, the output terminals may be located on the finger portions or the palm area generally, rather than simply on the palm area adjacent the thumb as illustrated in FIG. 1. Finally, the glove length obviously may be extended beyond the wrist thereby repositioning the circuit package 13, depending on individual suitability.

Training with the device of this invention should avoid contact with the output terminals with the face and especially the eyes. Also, direct contact over the heart, diaphragm area and solar plexus area should be avoided, and this includes the chest area in general. Contact with the output terminals with both hands of an individual definitely should be avoided since a dangerous circuit through the thoracic region could be completed. This means that contact by two gloves with the separate hands (or arms) of an individual also should be avoided. Contact with batteries such as hearing aids and pacemakers also should be avoided.

I claim:

1. An electrified device for temporarily incapacitating an individual or animal, comprising:
   (a) a battery;
   (b) transformer means for increasing voltage and reducing amperage from the battery;
   (c) a transistor oscillator for converting D.C. voltage to A.C. voltage to power the transformer and produce a continuous A.C. voltage output;
   (d) a rectifier and charging capacitor for converting a portion of the A.C. output to an intermittent D.C. output; and,
   (e) open terminal output means connecting to the A.C. and D.C. outputs, the transistor oscillator being connected directly through the capacitor to the terminal means;

whereby, an individual or animal who contacts the open terminals will be temporarily incapacitated, and the transistor oscillator will be buffered by the charging capacitor against reflected impedance signals due to contact with the terminals and thereby maintain continuous operation of the oscillator.

2. The device of claim 1, in which the battery is about 3 volts, D.C.

3. A method for temporarily incapacitating an individual or animal, comprising the steps of:
   (a) applying to the individual or animal, from open terminal means, a continuous A.C. voltage of about 450–50,000 volts at about 100 milliamps, and intermittent D.C. pulses of about 450–50,000 volts at about 100 milliamps;
   (b) the A.C. voltage and D.C. pulses being supplied by an electrical device, comprising:
      i. a battery;
      ii. transformer means for increasing voltage and reducing amperage from the battery;
      iii. a transistor means for converting D.C. voltage to A.C. voltage to power the transformer and produce a continuous A.C. voltage output;
      iv. a rectifier and capacitor means for converting a portion of the A.C. output of an intermittent D.C. output;
      v. the open terminal means being connected to the A.C. and D.C. outputs, and the transistor means being connected directly through the capacitor to the terminals; and,
   (c) removing the open terminal means from the incapacitated individual, or animal;

the transistor means being buffered by the charging capacitor against reflected impedance signals due to contact with the terminals, and thereby maintain continuous operation of the transistor means.

4. The device of claims 1 or 3, in which the D.C. output varies from about 400–750 volts at about 100 milliamps for about two seconds at intervals of about three seconds, and the A.C. output varies from about 500–750 volts at about 100 milliamps.

5. The device of claims 1 or 3, in which the battery is rechargeable.

6. The device of claims 1 or 3, in which the D.C. output varies from about 450–50,000 volts at about 100 milliamps and the A.C. output varies from about 500–50,000 volts at about 100 milliamps.

7. An electrical device for incapacitating an individual or animal, comprising:

I. (a) a closed glove structure, including a glove opening, palm and finger portions;

(b) open electrical terminals disposed on the palm area;

(c) a battery and electrical circuit container disposed near the glove opening;

(d) insulated connectors disposed within the glove for connecting the electrical terminals and electrical circuit, the glove being adapted for closure when in operation without causing an electrical shock to a user;

II. the electrical circuit including:

(a) a battery;

(b) transformer means for increasing voltage and reducing amperage from the battery;

(c) a transistor oscillator for converting D.C. voltage to A.C. voltage to power the transformer and produce a continuous A.C. voltage output;

(d) a rectifier and charging capacitor for converting a portion of the A.C. output to an intermittent D.C. output; and, (e) open terminal output means connecting to the A.C. and D.C. outputs, the transistor oscillator being connected directly through the capacitor to the terminal means; and, (f) switch means for connecting and disconnecting the battery and circuit from the terminals;

whereby, an individual or animal who contacts the open terminals will be temporarily incapacitated, and the transistor oscillator will be be buffered by the charging capacitor against reflected impedance signals due to contact with the terminals and thereby maintain continuous operation of the oscillator.

* * * * *